US007207612B2

(12) United States Patent
Raney

(10) Patent No.: US 7,207,612 B2
(45) Date of Patent: Apr. 24, 2007

(54) SUSPENDED LIFTING APPARATUS

(76) Inventor: Terry Raney, 14266 E. Valley Blvd., Industry, CA (US) 91746

( * ) Notice: Subject to any disclaimer, the term of this patent is extended or adjusted under 35 U.S.C. 154(b) by 0 days.

(21) Appl. No.: 11/088,081

(22) Filed: Mar. 23, 2005

(65) Prior Publication Data

US 2006/0214444 A1 Sep. 28, 2006

(51) Int. Cl.
*B66C 1/42* (2006.01)

(52) U.S. Cl. ..... 294/110.1; 294/117

(58) Field of Classification Search ..... 294/110.1, 294/117, 118, 106, 50.8, 51
See application file for complete search history.

(56) References Cited

U.S. PATENT DOCUMENTS

| | | | | | |
|---|---|---|---|---|---|
| 255,546 | A * | 3/1882 | Stephens | 294/4 |
| 1,129,664 | A * | 2/1915 | Gilchrist et al. | 294/110.1 |
| 1,159,680 | A * | 11/1915 | Johns | 294/110.1 |
| 1,169,004 | A * | 1/1916 | Cargin | 294/97 |
| 1,573,263 | A * | 2/1926 | Madden | 52/749.13 |
| 1,753,468 | A * | 4/1930 | McAlpine | 294/66.1 |
| 2,087,877 | A * | 7/1937 | Williams et al. | 294/106 |
| 2,378,570 | A * | 6/1945 | Mitchell | 294/110.1 |
| 3,001,812 | A | 9/1961 | Anderson | |
| 3,097,875 | A | 7/1963 | Kaplan | |
| 4,303,269 | A | 12/1981 | Faughnan | |
| 4,722,106 | A | 2/1988 | Scegiel et al. | |
| 5,184,860 | A | 2/1993 | Bouillon et al. | |
| 5,338,150 | A | 8/1994 | Focke et al. | |
| 5,480,201 | A | 1/1996 | Mercer | |
| 5,755,476 | A * | 5/1998 | Hosking | 294/106 |

* cited by examiner

*Primary Examiner*—Dean J. Kramer
(74) *Attorney, Agent, or Firm*—Edwin Tarver; Ty Ung; Patel & Alumit, P.C.

(57) ABSTRACT

A suspended lifting apparatus for grasping and releasing unwieldy objects. As the apparatus is raised, a hinged mechanism causes the weight of the object being lifted to draw extendable lever arms of the apparatus inward, thereby gripping the object. An articulating scooping mechanism at the bottom of the lever arms helps to grip or cradle the object as it is lifted, ensuring that it maintains a firm grip on the object. An offset mechanism is used to move the lever arms into an open position and hold them in that position before lifting, until the apparatus is in the proper position.

8 Claims, 5 Drawing Sheets

SUSPENDED LIFTING APPARATUS

CROSS-REFERENCE TO RELATED APPLICATION

None

FEDERALLY SPONSORED RESEARCH

Not Applicable

SEQUENCE LISTING OR PROGRAM

Not Applicable

BACKGROUND

The present invention relates to a lifting mechanism, and more particularly to an automatic lifting mechanism for heavy, unusually shaped and unwieldy objects.

Workers in industrial occupations frequently use automatic mechanisms when challenged with lifting and moving heavy objects. Devices currently exist for lifting large or heavy objects of a uniform shape, or those that are equipped with handles or similar attachment means. However, when it becomes necessary to grasp, raise, lower and release an oddly shaped, amorphous, soft or otherwise unwieldy object, the use of ordinary lifting devices becomes impractical or impossible.

Several lifting mechanisms have been developed employing a "pincer" mechanism to grasp and lift a variety of objects. U.S. Pat. No. 4,722,106 to Scegiel, et al., and U.S. Pat. No. 5,735,728 to Nickerson both disclose apparatuses for lifting bee hives, for instance. U.S. Pat. No. 3,788,694 to Hall discloses a handling system designed to carry stacks of articles. Although these mechanisms operate on similar principles, they share a common disadvantage; they are either impractical for use in a broad range of situations, or are not engineered to carry a substantial amount of weight.

Several other pincer-styled lifting means are disclosed by U.S. Pat. No. 6,039,374 to Klein; U.S. Pat. No. 5,480,201 to Mercer; U.S. Pat. No. 5,338,150 to Focke, et al.; and U.S. Pat. No. 4,303,269 to Faughnan. Although these machines bear a resemblance to the present invention, possessing a double-arm lifting means, they are all structurally different. Moreover, the means they employ to grasp and release an object is overly complicated. In addition, because of the limitations inherent in their designs, they are only practical for lifting specific objects, or at most, a limited range of shapes.

Therefore, there is a need for a lifting mechanism that is simple to operate, capable of lifting a large amount of weight, and designed to accomodate a wide variety of items; from heavy, oddly shaped materials, to soft, amorphous, or unwieldy objects. The present invention accomplishes all of these aims, and does so with an apparatus that is affordable and durable by design.

SUMMARY

In one preferred embodiment, the suspended lifting apparatus of the present invention includes a suspending bolt that extends downward through a hollow, open-ended yoke. Below the yoke, the bolt terminates at a specialized lug, which is fastened to two hoist members. The hoist members are attached so as to be able to articulate in a scissoring type of action from the specialized lug.

Each hoist member, at its opposite end, attaches to an elbow-shaped lever arm. The lever arms consisting of a vertical portion and a horizontal portion are attached, in turn, to the either end of the yoke. Therefore, as the suspension bolt slides through the yoke, the scissoring hoist members articulate down-and-outward or up-and-inward, and drive the lever arms closer or further apart.

In the preferred embodiment of the invention, the lever arms accommodate adjustable extension members that can slide through the vertical portion, and lock into place, lengthening or contracting the reach of the apparatus. In this embodiment, the lever arms are equipped with a cotter pin and pilot hole means for locking the extension members into place.

At the bottom of each extension member, a scooping or grabbing mechanism is attached on a hinge, allowing the scooping mechanism or other means to articulate back and forth. The scooping mechanism can therefore slide under the object to be lifted as the apparatus is lowered. The scooping mechanism can also be locked into position either automatically, or with the use of a cotter pin when properly seated under an object.

The broad nature of the scooping mechanism in the present embodiment, or the specialized form of the other preferred grabbing means, allows the apparatus to effectively lift large, amorphous, or unwieldy objects such as an engine block, feed bag, cadaver, etc. The scooping mechanism of the present embodiment can be easily replaced with another mechanism by removing bolts (functioning doubly as the hinges) for any of the various other scooping or lifting attachments.

The apparatus also has an offset mechanism connecting the yoke to the specialized lug at the bottom of the suspending bolt. The offset mechanism consists of an offset connector attached to a handle beam that is attached to a bracket on the yoke. The handle beam is equipped with a handle at the far end from the bracket. By lowering the handle beam, the offset mechanism spreads the lever arms open and locks them into position.

This feature is especially useful if the scooping mechanism must avoid touching an object as the apparatus is lowered into position. Another locking mechanism, such as a ratcheting assembly, is incorporated into the handle beam of the offset mechanism to prevent the handle end from rebounding if the handle is inadvertently released.

When the apparatus is in place, and the handle of the offset mechanism lifted, the weight of the lever arms causes the scooping mechanisms to seat under the object to be lifted. When the apparatus and object are lifted together, the hoist members extending from the specialized lug and suspension bolt cause the lever arms to pull together, gripping tightly the object to be lifted. As an alternative to this embodiment, the offset mechanism can be hydraulically, or pneumatically driven in the event hazardous materials, such as unexploded munitions, need to be handled.

When an object carried by the suspension apparatus is lowered into its final position, the offset mechanism is once again used to separate the lever arms from the object, and the apparatus lifts away free. In this manner, a wide variety of large objects can be handled easily with minimum effort by a small group or even a single person.

The design of the suspension apparatus allows a user to easily dismantle it if necessary, and since it is composed primarily of readily available materials, it can be repaired quickly and easily. These and other features, aspects, and advantages of the present invention will become better understood with reference to the following description and appended claims.

FIGURES—REFERENCE NUMERALS

10 . . . Suspended Lifting Apparatus
11 . . . Suspending Bolt
12 . . . Pilot Hole
13 . . . Yoke
14 . . . Specialized Lug
15 . . . Hoist Member
16A . . . Lever Arm (Outside-Vertical Portion)
16B . . . Lever Arm (Upper-Horizontal Portion)
17 . . . Bolt
18 . . . Threaded Bolt
19 . . . Threaded Pilot Hole
20 . . . Extension Member
21 . . . Cotter Pin Mechanism
22 . . . Scooping Mechanism
23 . . . Arced Plane
24 . . . Collar
100 . . . Offset Mechanism
101 . . . Offset Connector
102 . . . Handle Beam
103 . . . Handle
104 . . . Bracket
105 . . . Ratcheting Mechanism

Description

Figure 1:
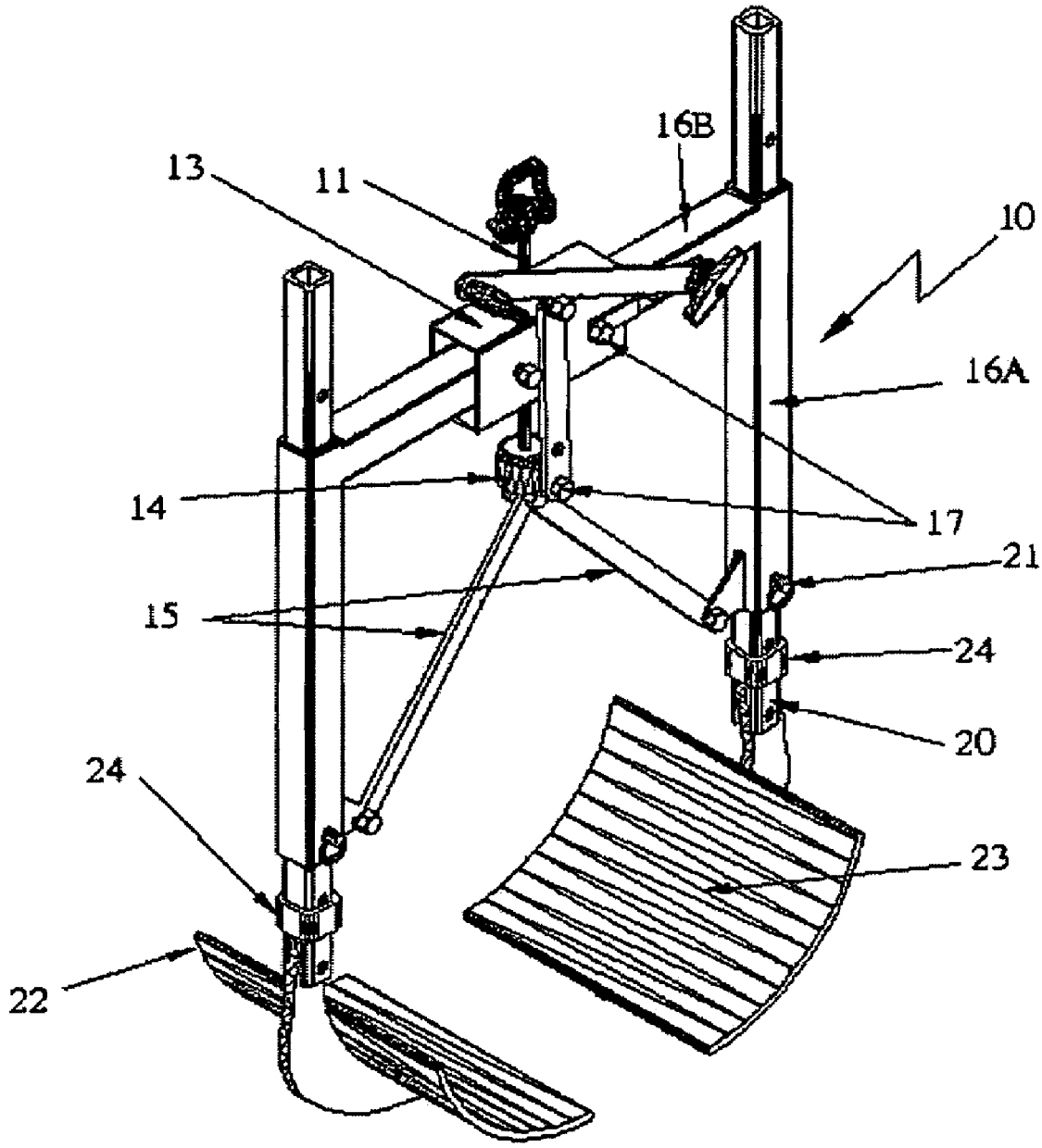
FIG. 1 is a front perspective view of the apparatus, showing the suspension bolt, yoke, hoist members, lever arms, scooping means and offset mechanism.
Figure 2:
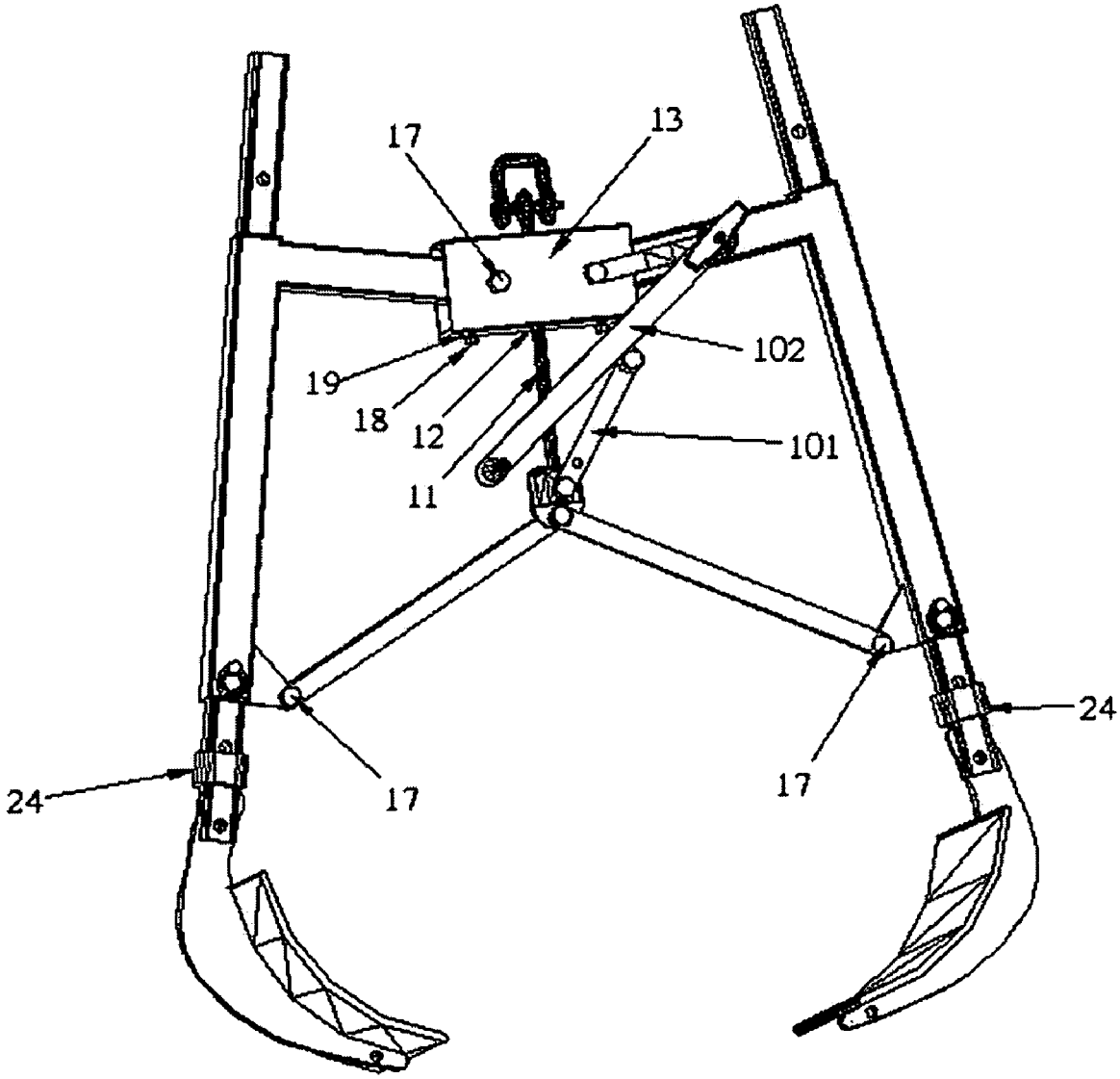
FIG. 2 is a front perspective view of the apparatus, showing the apparatus in an open position after lowering the handle beam.
Figure 3:
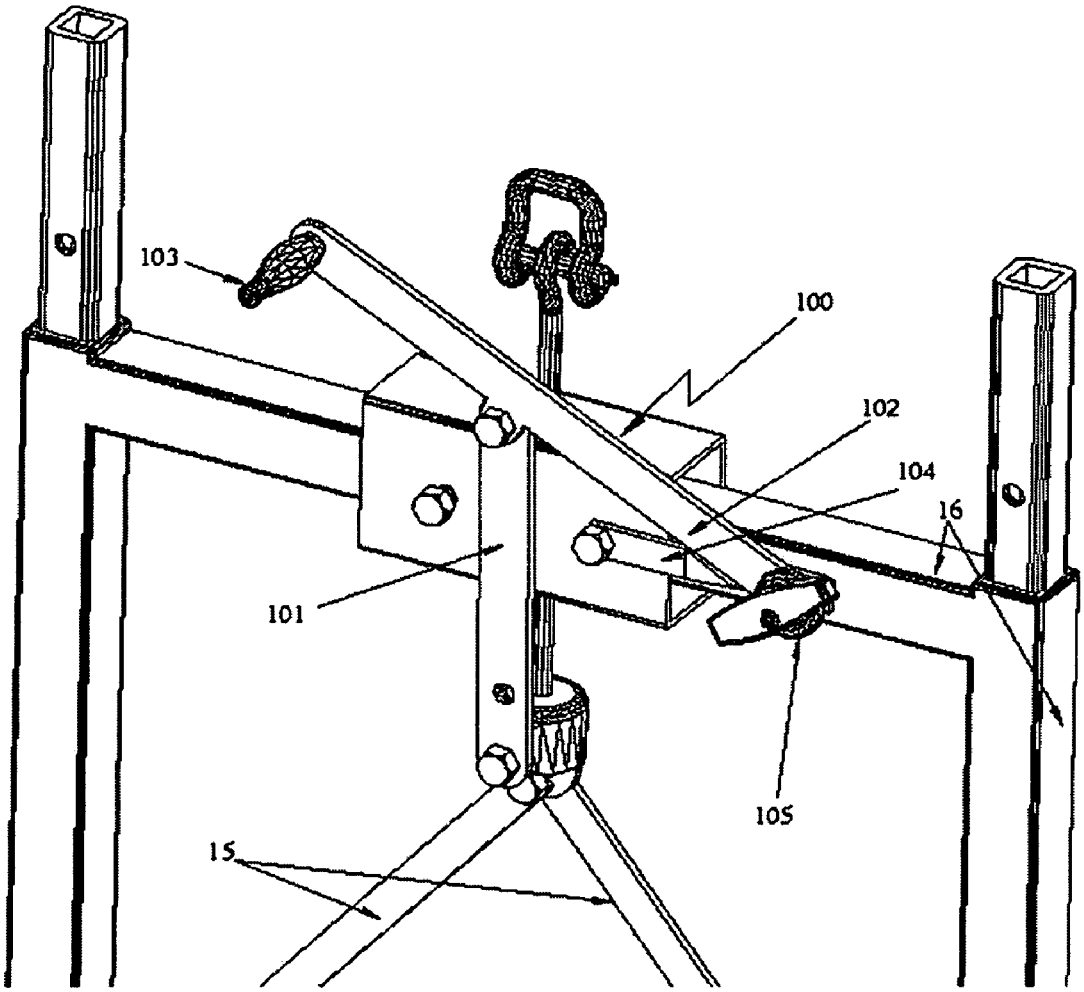
FIG. 3 is a close up of the offset mechanism, showing the offset connector, handle beam, handle, bracket, and ratcheting mechanism.
Figure 4:
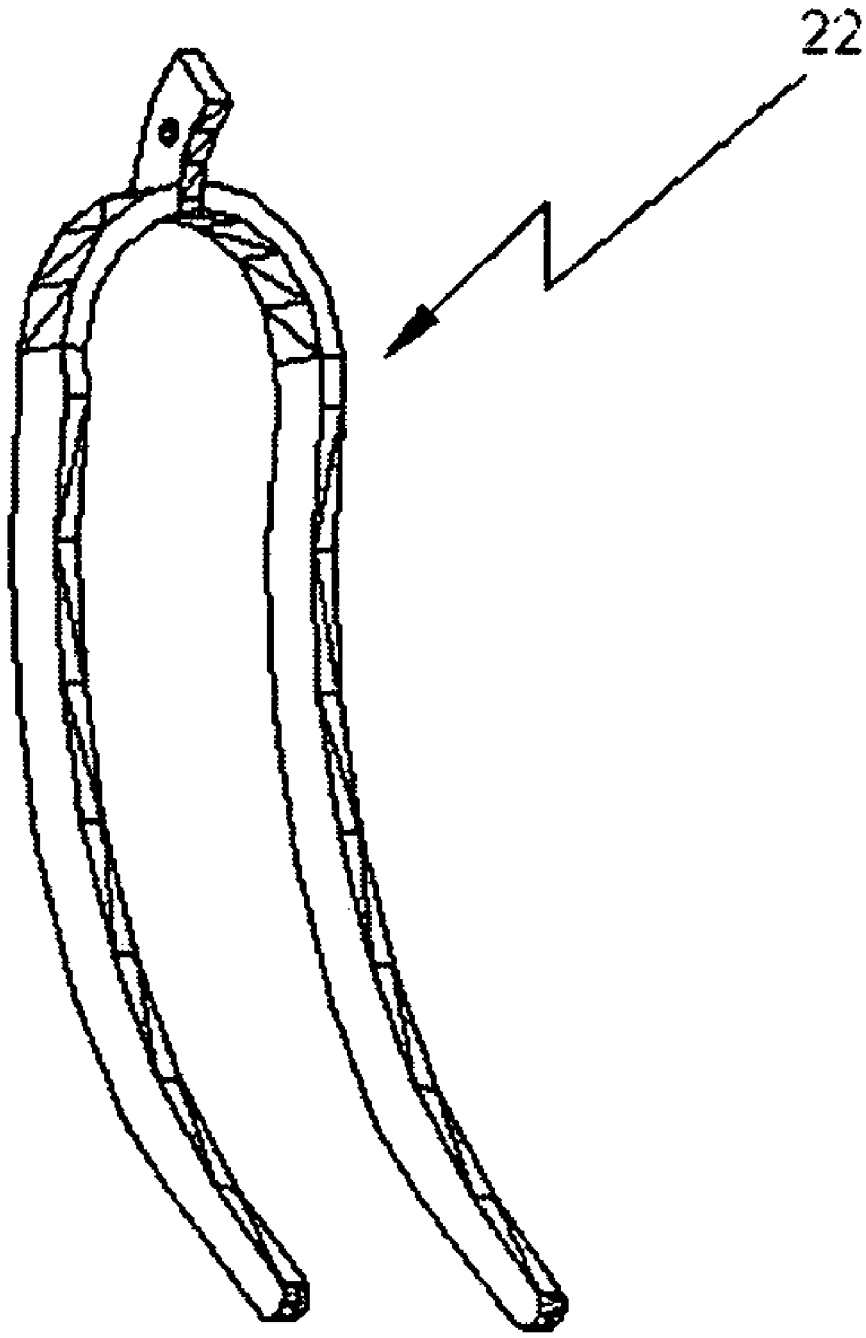
FIG. 4 shows an alternate embodiment of the scooping means as a forked structure.
Figure 5:
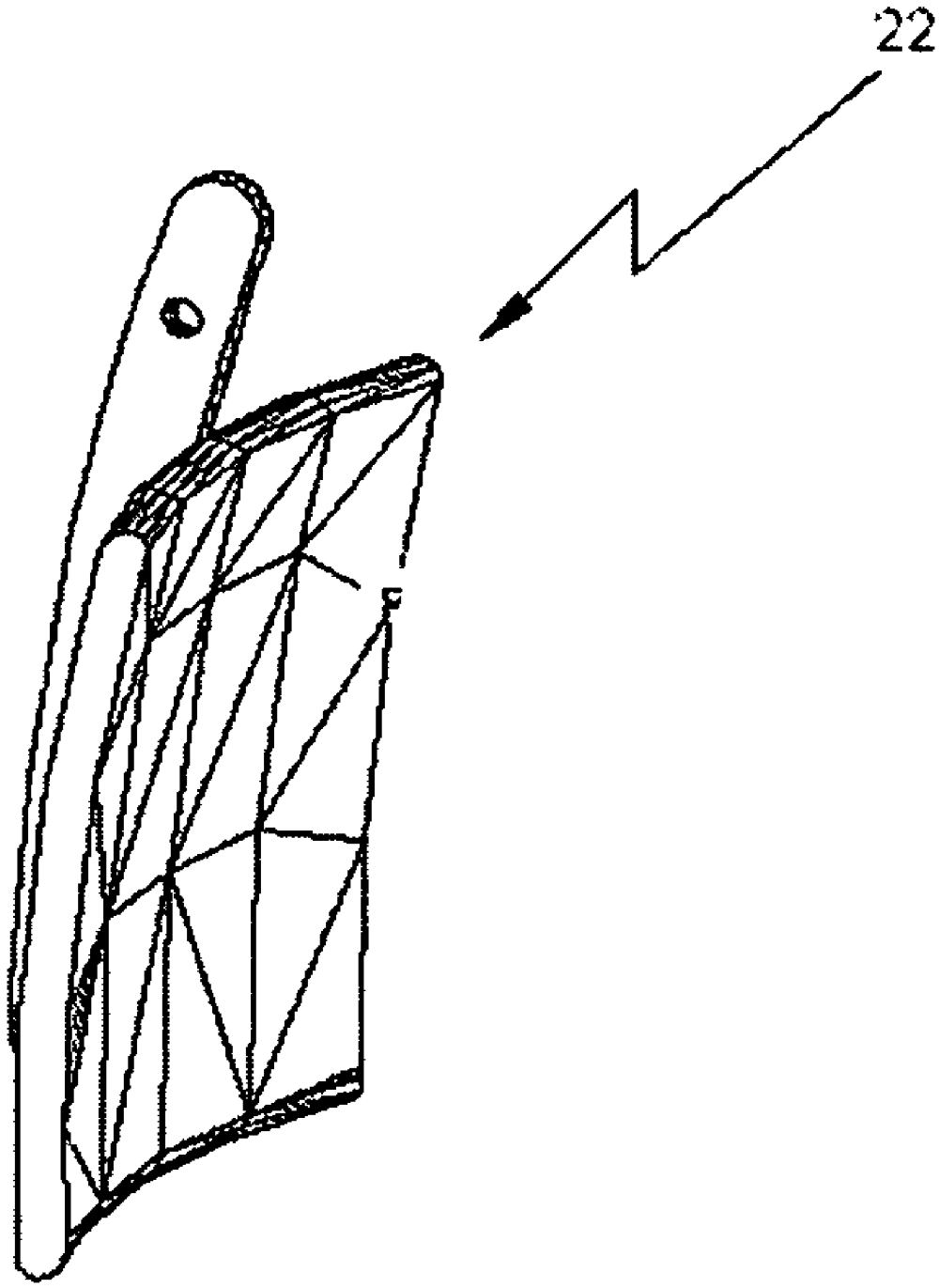
FIG. 5 shows a further embodiment of the scooping means as an elongated vertical scoop.

Referring to FIGS. 1–3, a suspended lifting apparatus 10 for grasping, raising, lowering and releasing unwieldy objects.

The apparatus 10 consists of a suspending bolt 11 comprising a metal dowel, eye-hook, or other similar structure that extends down through pilot holes 12 in the top and bottom of a rectangular box-shaped, hollow, side-end-open yoke 13. This allows the yoke 13 to move freely up and down the suspending bolt 11. The suspending bolt 11 extends below the yoke 13 at approximately an equal distance as above it, and terminates at a specialized lug 14.

The specialized lug 14 is bolted to two hoist members 15 that extend down at opposite angles. The hoist members 15 are bolted loosely to allow them to articulate back and forth in the plane of the apparatus 10. The opposite ends of the hoist members 15 are bolted to the bottom of, respectively; two elbow or "L" shaped lever arms 16. The lever arms 16 are arranged with respect to the apparatus 10, so that they comprise an outside vertical portion 16A, and a top horizontal portion 16B. The hoist members 15 are bolted loosely to the bottom of the vertical portions 16A in order to articulate freely in the plane of the apparatus 10.

The end of the horizontal portions 16B of the lever arms 16 opposite the vertical portions 16A extend into the open ends of the yoke 13 and are held in place by bolts 17 or other similar hinging means extending through the yoke 13 from front to back. They are hinged loosely to allow the lever arms 16 to articulate back and forth in the plane of the apparatus 10. Two threaded bolts 18 or other adjustable stopping mechanisms extend through a threaded pilot hole 19 in the underside of each end of the yoke 13 to a desired height. As the threaded bolts 18 are raised, the proximity to which the lever arms 16 can close together is limited.

In one preferred embodiment of the invention, extension members 20 extend through the vertical portions of the lever arms 16A and slide up or down to increase or decrease the reach of the apparatus 10. The extension members 20 in one preferred embodiment are equipped with pilot holes that allow a cotter-pin mechanism 21 to lock the extension members 20 at a preferred height.

At the bottom terminal end of the extension members 20, scooping mechanisms 22 are attached using bolts 17 that double as hinges. They are attached loosely to allow the scooping mechanisms 22 to articulate in the plane of the apparatus 10. The scooping mechanisms 22, in one preferred embodiment of the invention, have a curved, lobed upper portion. This causes a collar 24 encircling the bottom of an extension member 20 to lift as the lobe comes into alignment with the extension member 20, and drop into place around the lobe when it aligns with the extension member 20, locking the scooping mechanism 22 into place. In another embodiment of the invention, a cotter-pin or spring-pin can be used to lock the scooping mechanisms 22 into place at various positions.

The scooping mechanisms 22 in the preferred embodiment of the invention consist of a pair of arced planes 23 extending perpendicular to the plane of the apparatus 10 and facing each other in a mirror-image orientation. The arced planes 23 are oriented to perform a shoveling action in the plane of the apparatus 10 on the object to be lifted. Furthermore, the scooping mechanisms 22 can articulate to travel inward along a surface toward an object, until the collars on the extension members 20 fall into place and lock the scooping mechanisms 22 into position.

To hold the lever arms 16 apart as the apparatus 10 is lowered around an object, an offset mechanism 100 is employed. The offset mechanism 100 consists of an offset connector 101 bolted to the specialized lug 14 at the lower terminal end of the suspension bolt 11. The other end of the offset connector 101 is bolted to a handle beam 102. The offset connector 101 is bolted loosely, to allow both ends to articulate in the plane of the apparatus 10. The handle beam 102 is attached to a handle 103 at one end, and attached to a ratcheting mechanism 105 and bracket 104 which is bolted the yoke 13 at the other to act as an articulating hinge, at a point beyond where the off-set connector 101 attaches.

The handle beam 102 and ratcheting mechanism 105 are attached to a bracket 104 that is bolted 17 to the yoke 13. This mechanism allows the handle beam 102 to ratchet as it is lowered, preventing it from rebounding quickly if the handle 103 is inadvertently released.

In order to use the invention to lift an unwieldy object, such as an industrial sack of flour or large animal, among other things, the apparatus 10 is suspended from a hook or other motorized lifting means. As the apparatus 10 hangs from its position, the weight of the apparatus 10 causes the yoke 13 to descend along the suspension bolt 11, and the upward pull of the suspension bolt 11 on the hoist members 15 causes the hoist members to pull the lever arms 16 inward.

In order to separate the lever arms 16, the handle 103 of the offset mechanism 100 is pulled down. As the handle 103 moves down, it pushes the lower end of the offset connector 101 and the specialized lug 14 down and away from the yoke 13, causing the yoke 13 to slide up along the suspension bolt 11. As this occurs, the hoist members 15 hinge open, thereby increasing the distance between the scooping mechanisms 22.

Simultaneously, the upper end of the offset connector 101 swings into an off-center position, until it travels beyond a one-dimensional plane established between the attached end of the handle beam 102 and the lower end of the offset connector 101. When the upper end of the offset connector 101 crosses this border, the weight of the lever arms 16 causes the upper end of the offset connector 101 to push away from the center of the apparatus 10 thereby holding the apparatus 10 in an open position. The upper end of the offset connector 101 is prevented from traveling beyond the plane by the handle beam 102 coming into contact with the bolt 17 at the bottom end of the offset connector 101. A ratcheting mechanism 105 holds the handle 103 in place as it is lowered to prevent it from rebounding quickly in the event it is inadvertently released before reaching the offset position.

When the apparatus 10 is in position to lift an object, the handle 103 can be raised, and the lever arms 16 move inward. Along with this process, the scooping mechanisms 22 can articulate inward along a plane on which the object sits, gradually increasing toward an inward oriented position, until the lobe and collar mechanisms above the scooping means hinge lock them into place.

With the scooping mechanisms inserted as far as possible under the object, the apparatus 10 is lifted. As a motorized lift pulls the suspension bolt 11 up, pulling the specialized lug 14 upward, the upper ends of the hoist members are also raised, which in turn exerts an inward pull on the lever arms 16. In this manner, the apparatus "grips" the object as it lifts.

When the apparatus is lowered, the offset mechanism 100 can be used to separate the lever arms 16 once the weight of the object is removed from the scooping mechanisms 22. A person using the invention can also manually push the arms apart easily after the weight of the object is removed from the scooping mechanisms 22.

Since the apparatus 10 uses the weight of the object being moved to grip the object, it can be used effectively in place of a motorized lifting mechanism, which would require a power source and take up much more room. In addition, the apparatus 10 is constructed primarily of readily available materials that can be procured easily in the event repairs are needed. Since the design of the invention is simple, it is also easy for a person using it to determine what kind of repair is needed. Finally, because the apparatus 10 is made of high quality industrial materials, it can lift much more weight than comparable mechanisms, and is therefore suited to a variety of applications.

The preferred embodiment mentioned above describes a manual handle-driven offset mechanism 100. However, in the event that the apparatus 10 is used under dangerous conditions, such as in a radioactive or biochemical spill area, or to retrieve unexploded munitions, it can be equipped with a hydraulic or pneumatic means to operate the offset mechanism 100.

Other embodiments of the apparatus 100 include the use of geared mechanisms for the extension arms, and hinged scooping means 24 to establish a pre-determined configuration for lifting items with known dimensions and specific lifting requirements. Further embodiments may also include a variety of scooping means for lifting a broad range of objects.

Some of the alternate scooping means include; an elongated scoop for lifting long quasi-cylindrical objects such as statuary or a cadaver, a rake to catch on small variegated surfaces of a hard amorphous object such as a piece of concrete rubble, a fork for puncturing an object, a loop mechanism for lassoing an object, among others. Still other embodiments include the apparatus 10 comprise of alternate materials such as resin or industrial plastics, and a bowed shape to the lever arms 16 to accommodate even larger objects.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

While specific apparatus has been disclosed in the preceding description, it should be understood that these specifics have been given for the purpose of disclosing the principles of the present invention and that many variations thereof will become apparent to those who are versed in the art. Therefore, the scope of the present invention is to be determined by the appended claims.

Any element in a claim that does not explicitly state "means for" performing a specified function, or "step for" performing a specific function, is not to be interpreted as a "means" or "step" clause as specified in 35 U.S.C. § 112, paragraph 6. In particular, the use of "step of" in the claims herein is not intended to invoke the provisions of 35 U.S.C. § 112, paragraph 6.

What is claimed is:

1. A suspended lifting apparatus for grasping, raising, lowering and releasing unwieldy objects comprising;

(a) a suspending means descending through a yoke and affixed to a hinged pair of hoist members articulating in a scissoring movement;

(b) each hoist member pivotally connected to the bottom of the vertical section of a pair, respectively, of mirror-image articulating elbow or "L" shaped lever arms;

(c) each lever arm consisting of and attached so as to comprise an outside oriented vertical section and a top oriented horizontal portion, wherein the terminal end of the top horizontal portion opposite the outside vertical section is pivotally hinged to the yoke of the apparatus;

(d) each lever arm further comprising an adjustable raising and lowering lockable extension member along its vertical section wherein two mirror-image hinged, swinging, lockable, inwardly facing scooping means attached to the bottom terminus of each lockable extension member with a hinge;

(e) further comprising an offset mechanism means for opening and preserving in an open position the lever arms, comprising;

(i) a vertical hinged offset member attached at its bottom end to a bottom portion of the suspending means that descends below the yoke and at its top end to an articulating handle beam;

(ii) the articulating handle beam affixed at one terminal end to a handle and at the other terminal end, to a bracket attached to the yoke;

(iii) the vertical hinged offset member connected to the articulating handle beam at a point serving to open the lever arms when the handle is lowered;

(iv) the vertical hinged offset member connected to the articulating handle beam at a point serving to keep it in a lowered position under the weight of the opened lever arms when the handle is lowered; and (v) a locking or ratcheting mechanism attached to the articulating handle beam to hold it in an up or down position for holding the lever arms in an open or closed position.

2. The apparatus of claim 1, wherein the scooping means are comprised of solid curved planes elongated along their horizontal axis.

3. The apparatus of claim 1, wherein the scooping means comprise a variety of grasping means, including forks, for grasping fragile objects.

4. The apparatus of claim 1, wherein the scooping means automatically lock into position through the use of sliding collars driven up the extension members by an arced lobe incorporated into the scooping means above the hinge and automatically fall into place when the lobes align with the extension members.

5. The apparatus of claim 1, wherein the locking mechanism of the articulating handle beam is a ratcheting mechanism that can selectively lock in an open or closed position.

6. The apparatus of claim 1, wherein the extension members slide back and forth through the vertical portion of the lever arms and lock into place.

7. The apparatus of claim 1, wherein adjustable bolts extend through the underside of either end of the yoke to provide a stopping means, preventing the lever arms from closing together beyond a certain point.

8. The apparatus of claim 1, wherein the material of the suspended lifting apparatus comprises metal, resin, durable plastics or other industrial materials.

* * * * *